US006479206B1

(12) United States Patent
Suzuki et al.

(10) Patent No.: US 6,479,206 B1
(45) Date of Patent: Nov. 12, 2002

(54) TONER FOR DEVELOPING ELECTROSTATIC LATENT IMAGE, PROCESS FOR PRODUCING THE SAME, DEVELOPER FOR DEVELOPING ELECTROSTATIC LATENT IMAGE, AND PROCESS FOR FORMING IMAGE

(75) Inventors: Chiaki Suzuki, Minamiashigara (JP); Masahiro Takagi, Minamiashigara (JP); Satoshi Inoue, Minamiashigara (JP); Yosuke Tsurumi, Minamiashigara (JP); Kozo Ota, Minamiashigara (JP); Sakon Takahashi, Minamiashigara (JP); Tomohito Nakajima, Minamiashigara (JP); Atsuhiko Eguchi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/132,145

(22) Filed: Apr. 26, 2002

Related U.S. Application Data

(62) Division of application No. 09/583,543, filed on Jun. 1, 2000, now Pat. No. 6,403,271.

(30) Foreign Application Priority Data

Aug. 24, 1999 (JP) ..... 11-237196

(51) Int. Cl.[7] ..... G03G 9/08
(52) U.S. Cl. ..... 430/137.14; 523/335
(58) Field of Search ..... 430/137.14; 523/335

(56) References Cited

U.S. PATENT DOCUMENTS

| | | | |
|---|---|---|---|
| 5,422,214 | A | 6/1995 | Akiyama et al. |
| 6,042,979 | A | 3/2000 | Ohishi et al. |
| 6,117,607 | A | 9/2000 | Shimizu et al. |

FOREIGN PATENT DOCUMENTS

| | | | |
|---|---|---|---|
| JP | 56-125751 | A | 10/1981 |
| JP | 62-184469 | A | 8/1987 |
| JP | 62-267766 | B2 | 11/1987 |
| JP | 3-100661 | A | 4/1991 |
| JP | 4-40471 | A | 2/1992 |
| JP | 5-94113 | A | 4/1993 |
| JP | 6-266152 | A | 9/1994 |
| JP | 6-308759 | A | 11/1994 |
| JP | 7-28276 | A | 1/1995 |
| JP | 7-120086 | B2 | 12/1995 |
| JP | 8-44220 | A | 2/1996 |
| JP | 8-115007 | A | 5/1996 |
| JP | 2676849 | B2 | 7/1997 |
| JP | 9-319134 | A | 12/1997 |
| JP | 10-213977 | A | 8/1998 |
| JP | 10-312089 | A | 11/1998 |

*Primary Examiner*—John Goodrow
(74) *Attorney, Agent, or Firm*—Oliff & Berridge, PLC

(57) ABSTRACT

A toner for developing an electrostatic latent image, a process for producing the same, and a developer for developing an electrostatic latent image using the same are provided, in which the toner flowability, the charging property, the developing property, the transferring property and the fixing property are simultaneously satisfied in a long period of time. The toner for developing an electrostatic latent image comprising a colored particles containing a binder resin, a coloring agent and a releasing agent, and an external additive, the external additive containing a monodisperse spherical inorganic oxide having a true specific gravity of from 1.3 to 1.9 and a volume average particle diameter of from 80 to 300 nm. It is preferred that the inorganic oxide is silica, the colored particles have a shape coefficient of 125 or less, and the external additive further contains a reaction product of metatitanic acid and a coupling agent, which has an electric resistance of $10^{10}$ Ω·cm or more.

9 Claims, 1 Drawing Sheet

TONER FOR DEVELOPING ELECTROSTATIC LATENT IMAGE, PROCESS FOR PRODUCING THE SAME, DEVELOPER FOR DEVELOPING ELECTROSTATIC LATENT IMAGE, AND PROCESS FOR FORMING IMAGE

This is a Division of Application Ser. No. 09/583,543 filed Jun. 1, 2000 now U.S. Pat. No. 6,403,271. The entire disclosure of the prior application is hereby incorporated by reference herein in its entirety.

FIELD OF THE INVENTION

The present invention relates to a toner for developing an electrostatic latent image, a process for producing the same, a developer for developing an electrostatic latent image, and a process for forming an image in an electrophotographic process and an electrostatic recording method.

BACKGROUND OF THE INVENTION

In the electrophotographic process, an electrostatic latent image formed on a latent image holding member (photoreceptor) is developed with a toner containing a coloring agent, and a resulting toner image is transferred to a transferring material and then fixed with a heat roll, so as to obtain an image. The latent image holding member is separately subjected to cleaning for forming another electrostatic image.

A dry developer used in the electrophotographic process is roughly classified to a one-component developer solely using a toner containing a binder resin and a coloring agent and a two-component developer containing the toner mixed with a carrier. The one-component toner can be further classified to a magnetic one-component type, in which magnetic powder is used and the developer is transported by a developing roll with a magnetic force, and a non-magnetic one-component type, in which magnetic powder is not used and the developer is transported by a developing roll with application of charge by a charging roll.

Since a second half of the 1980s, an apparatus of a compact size and sophisticated performance is demanded in the market of electrophotography based on a trend of digitization, and particularly with respect to quality of a full color image, high class printing and high image quality equivalent to a silver halide photography. A digitized process is indispensable as means for attaining high image quality, and an effect of the digitization in image quality includes the complicated image processing that can be conducted at a high speed. By employing such a digitized process, text information and photographic image information can be controlled separately, and thus the reproducibility of the quality of both of them is greatly improved in comparison to the analog technology. Particularly, with respect to a photographic image, it is notable that gray level correction and color correction can be conducted, and the digitized process is advantageous over the analog technology in gray level characteristics, fineness, sharpness, color reproducibility and graininess. However, a latent image formed by an optical system must be faithfully reproduced as an image output, and therefore an attempt of realizing faithful reproduction is increasingly conducted with the decrease in particle diameter of a toner. However, it is difficult to stably obtain high image quality only by decreasing the particle diameter of the toner, and there is increasing importance in improvement of basic characteristics of development, transferring and fixing characteristics.

In particular, a color image is formed by superimposing color toners of three colors or four colors. Therefore, when at least one of the toners exhibits different performance from the initial stage or different performance from the toners of the other colors from the standpoint of development, transferring or fixing, deterioration in image quality occurs, such as deteriorated color reproducibility, low graininess and color unevenness. It is an important demand to maintain an image having stable high image quality equivalent to the initial stage even after the lapse of time that the characteristics of the toners are stably controlled. It has been reported that a toner is agitated in a developing device, and the fine structure on the surface of the toner is easily changed, to cause great change in transferring property (JP-A-10-312089).

In recent years, a cleaning system without cleaner has been proposed from the standpoints of miniaturization of an apparatus for space saving, decrease of the waste toner for environmental protection, and prolongation of the service life of the latent image holding member. In the cleaning system without cleaner, without using a cleaning system, the toner remaining on a photoreceptor drum after transferring is dispersed by a brush in contact with the photoreceptor drum, and the dispersed toner is recovered by the developing device simultaneously with development (JP-A-5-94113). In general, when the remaining toner is recovered simultaneously with development, because the recovered toner has different charging characteristics from the other toners to cause problems in that the recovered toner is not developed but is accumulated in the developing device, it is necessary that the transferring efficiency is further improved to control the amount of the recovered toner to the minimum value.

It is proposed to make the shape of the toner approaching a sphere shape to improve the. flowability, the charging property and the transferring property (JP-A-62-184469). However, the following problems occur when the toner has a sphere shape. A developing device is equipped with a transporting amount controlling plate for controlling the transporting amount of the developer constant, and it can be controlled by changing the distance between a magnet roll and the transporting amount controlling plate. However, when a toner having a sphere shape is used, the flowability of the developer is increased, and at the same time, the tapped bulk density thereof is increased. As a result, a phenomenon occurs in that the developer piles up at a part where the transportation thereof is controlled, and the transporting amount becomes unstable. While the transporting amount can be somewhat improved by controlling the surface roughness of the magnet roll and making the distance between the controlling plate and the magnet roll small, the packing phenomenon due to piling up of the developer is becomes remarkable to increase the stress applied to the toner. A problem has been confirmed in that, owing to the phenomenon, the change of the micro structure of the surface of the toner, particularly burying and peeling of an external additive, readily occurs, and thus the developing property and the transferring property are greatly changed from those in the initial stage.

In order to solve the problems, it has been reported that the packing phenomenon is suppressed by using a spherical toner and a non-spherical toner in combination to attain high image quality (JP-A-6-308759). However, although the packing phenomenon is effectively suppressed, the non-spherical toner is liable to remain as a transferring residue, and a high transferring efficiency cannot be attained. Furthermore, in the case where the simultaneous recovering of the developer is conducted, there is a problem in that the non-spherical toner as the transferring residue is recovered to increase the proportion of the non-spherical toner, and the transferring efficiency is further decreased.

There has been disclosed that in order to improve the developing property, the transferring property and cleaning property of a spherical toner, two kinds of inorganic fine particles, one of which has an average particle diameter of 5 mμ or more and less than 20 mμ, and the other of which has an average particle diameter of from 20 to 40 mμ, are used in combination, which are added in specific amounts (JP-A-3-100661). While this method provides excellent developing property, transferring property and cleaning property in the initial stage, because the stress applied to the toner cannot be reduced after the lapse of time, burying and peeling of an external additive readily occurs to greatly change the developing property and the transferring property from those in the initial stage.

It has been disclosed that the use of inorganic fine particles is effective to suppress the burying of the external additive on the toner (colored particles) due to the stress (JP-A-7-28276, JP-A-9-319134 and JP-A-10-312089). However, since the true specific gravity of the inorganic particles is large, the peeling of the external additive becomes unavoidable due to the stress of agitation in the developing device when the external additive particles become large. Furthermore, because the inorganic particles do not have a complete spherical shape, it is difficult to control the standing of the external additives to a constant extent when it is adhered on the surface of the toner (colored particles) . Accordingly, unevenness occurs in the microscopic shape of surface unevenness functioning as a spacer, and the stress is selectively applied at the protruded parts, whereby the burying and peeling of the external additive is further accelerated.

There has been disclosed that organic fine particles of from 50 to 200 nm are added to the toner (colored particles) to effectively manifest the function of spacer (JP-A-6-266152) By using spherical organic fine particles, the function of spacer can be effectively manifested in the initial stage. However, although the organic fine particles exhibit less burying and peeling on application of stress of lapse of time, the organic fine particles themselves are deformed, and thus the high function of spacer cannot be stably manifested. Furthermore, it can be considered that a large amount of the organic fine particles are adhered on the surface of the toner (colored particles), or in alternative, organic fine particles having a large particle diameter are used, but in such cases, the characteristics of the organic fine particles are largely reflected. That is, adverse affects on charging and development occurs in that the powder characteristics of the toner added with inorganic particles are adversely affected, i.e., the flowability and the thermal cohesiveness are deteriorated, and the freedom of controlling the charging property is lowered because the organic fine particles themselves have a charge application function.

In recent years, there are great requests on color printing, particularly on-demand printing, and a method has been reported in that a multi-color image is formed on a transferring belt for high-speed duplication, and the multi-color image is transferred to a image fixing material at a time, followed by fixing (JP-A-8-115007). In this method, transferring is repeated twice, i.e., the primary transferring from a photoreceptor to the transferring belt and the secondary transferring from the transferring belt to a transferring material, and as a result, the importance of the technique for improving the transferring efficiency is increased. Particularly in the secondary transferring, the multi-color image is transferred at a time, and the conditions of the transferring material (such as the thickness and the surface property of paper) variously changed, the charging property. Thus, in order to suppress the influence thereof, the developing property and the transferring property are necessarily controlled in a precise manner.

It has also been disclosed a technique in that respective color images are transferred to an intermediate transferring material and then subjected to simultaneous transferring and fixing on a transferring material for saving the consuming electric power and the space and for obtaining an image having high image quality. (JP-A-10-213977 and JP-A-8-44220). What is important in this technique is that a transferring belt must have both the transferring function and the fixing function. That is, because a primary transferring part must have an improved transferring property in a cooled state, and a secondary simultaneous transferring and fixing part must transfer heat at once, a thin layer belt having high heat resistance is used as a material of the belt. Because the transferring efficiency is controlled to an extremely high level, and a large pressure cannot be applied on fixing, a toner is demanded to cope with a low fixing pressure. It is also important that the contamination with the toner on fixing and flaws due to an external additive are minimized as possible on the surface of the belt since the belt also has a transferring function.

Method have been proposed in that high image quality is realized, in particular, a half tone, a solid image and letters are faithfully reproduced, by controlling the volume resistivity of the carrier (JP-A-56-125751, JP-A-62-267766 and JP-A-7-120086). In these methods, the resistivity is controlled by the species of the carrier coating layer and the coating amount, and the objective volume resistivity can be obtained in the initial stage to provide high image quality. However, peeling of the carrier-coating layer occurs due to the stress in the developing device, and thus the volume resistivity is greatly changed. Therefore, the high image quality cannot be manifested in a long period of time.

Furthermore, a method has been proposed in that the volume resistivity is controlled by adding carbon black to the carrier-coating layer (JP-A-4-40471). The method can suppress the change of the volume resistivity due to peeling of the coating layer. However, an external additive added to the toner or the constitutional component of the toner is adhered on the carrier to change the volume resistivity of the carrier, and therefore it is difficult to manifest high image quality in a long period of time as similar to the carrier described in the foregoing.

SUMMARY OF THE INVENTION

The invention has been made to solve the problems associated with the conventional techniques to provide a toner for developing an electrostatic latent image, a process for producing the same, and a developer for developing an electrostatic latent image using the same, which have the following features, i.e., the toner flowability, the charging property, the developing property, the transferring property and the fixing property are simultaneously satisfied in a long period of time; a blade cleaning step accelerating the wear of a latent image holding member is not employed; and the residual transferred toner is recovered simultaneously with the development, or the residual toner remaining on the latent image holding member is recovered by an electrostatic brush. The invention also provides a process for forming an image, in which development, transferring and fixing that cope with the demand of high image quality can be conducted.

As a result of earnest investigation made by the inventors, the problems described in the foregoing can be solved by using a specific monodisperse inorganic oxide as an external additive of a toner, so as to complete the invention.

The invention relates to, as a first aspect, a toner for developing an electrostatic latent image comprising a colored particles containing a binder resin, a coloring agent and a releasing agent, and an external additive, the external additive containing a monodisperse spherical inorganic oxide having a true specific gravity of from 1.3 to 1.9 and a volume average particle diameter of from 80 to 300 nm.

In the toner for developing an electrostatic latent image of the first aspect, it is preferred that the inorganic oxide is silica.

In the toner for developing an electrostatic latent image of the first aspect, it is preferred that the colored particles have a shape coefficient represented by the following equation of 125 or less:

$$\text{Shape coefficient of colored particles}=(R^2/S)\cdot(\pi/4)\cdot 100$$

wherein R represents a maximum length of a diameter of the colored particles, and S represents a projected area of the colored particles.

In the toner for developing an electrostatic latent image of the first aspect, it is preferred that the external additive further contains a reaction product of metatitanic acid and a coupling agent, which has an electric resistance of $10^{10}$ Ω·cm or more.

In the toner for developing an electrostatic latent image of the first aspect, it is preferred that the monodisperse spherical inorganic oxide is added in an amount of from 0.5 to 5 parts by weight per 100 parts by weight of the colored particles.

The invention also relates to, as a second aspect, a developer for developing an electrostatic latent image containing a toner for developing an electrostatic latent image of the first aspect of the invention and a carrier.

In the developer for developing an electrostatic latent image of the second aspect, it is preferred that the carrier contains a core material covered with a resin coating layer.

In the developer for developing an electrostatic latent image of the second aspect, it is preferred that the carrier contains a core material covered with a resin coating layer containing a matrix resin having a conductive material dispersed therein.

In the developer for developing an electrostatic latent image of the second aspect, it is preferred that the carrier has a shape coefficient represented by the following equation of 120 or less, a true specific gravity of from 3 to 4, and a saturation magnetization at 5 kOe of 60 40 emu/g or more:

$$\text{Shape coefficient of carrier}=(R'^2/S')\cdot(\pi/4)\cdot 100$$

wherein R' represents a maximum length of a diameter of the carrier, and S represents a projected area of the carrier.

In the developer for developing an electrostatic latent image of the second aspect, it is preferred that the carrier has a volume resistivity of from $10^6$ to $10^{14}$ Ω·cm on application of an electric field of 1,000 V/cm.

In the developer for developing an electrostatic latent image of the second aspect, it is preferred that the core material of the carrier is a magnetic powder dispersion type spherical core produced by a polymerization method.

In the developer for developing an electrostatic latent image of the second aspect, it is preferred that the carrier contains magnetic powder in the form of fine particles in an amount of 80% by weight based on the total weight of the carrier.

The invention also relates to, as a third aspect, a process for forming an image containing a step of developing an electrostatic latent image formed on a latent image holding member with a toner to form a toner image, and a step of transferring the toner image to a transferring material to form a transferred image, the toner being a toner for developing an electrostatic latent image of the first aspect of the invention.

In the process for forming an image of the third aspect, it is preferred that the toner image contains color toner images of respective colors, the transferring step contains a step of transferring the color toner images of respective colors to a transferring belt or a transferring drum, and then a step of transferring the color toner images of respective colors to a transferring material at a time.

In the process for forming an image of the third aspect, it is preferred that upon transferring the color toner images of respective colors to the transferring material at a time, fixing is conducted simultaneously with transferring.

In the process for forming an image of the third aspect, it is preferred that a residual toner remaining on the latent image holding member is recovered with an electrostatic brush.

In the process for forming an image of the third aspect, it is preferred that a residual toner remaining on the latent image holding member is recovered into a developing device.

While the development and transferring are influenced by the general transporting property of the developer and the electric current on transferring, they are a process of pulling toner particles away from the binding power of a carrier carrying the toner particles, and adhering the same on the object (a latent image holding member or a transferring material), and therefore they are influenced by balance between the electrostatic attracting force and the adhesion force between the toner particles and a charge controlling member or between the toner particles and the latent image holding member. While the balance is difficult to be controlled, the process directly influences the image quality, and when the efficiency thereof is improved, improvement in reliability and power saving by employing no cleaning step are expected. Thus, higher development and transferring properties are demanded in the process. The development and transferring occur when the electrostatic attracting force is larger than the adhesion force. Therefore, in order to improve the efficiency of the development and transferring, the electrostatic attracting force is increased (i.e., the development and transferring power is increased), or the adhesion force is decreased. In the case of increasing the development and transferring force, when the transferring electric field is increased, for example, a secondary fault, such as formation of an inversely polarized toner, is liable to occur. Therefore, it is more effective to decrease the adhesion force.

The adhesion force includes a Van der Waals force (non-electrostatic force) and an image force by an electric charge of the colored particles. There is a difference of substantially one order between the forces, and the adhesion force can be discussed only by a Van dar Waals force. The Van dar Waals force F between spherical particles can be expressed by the following equation:

$$F=H\cdot r_1\cdot r_2/6(r_1+r_2)\cdot a^2$$

wherein H is a constant, $r_1$ and $r_2$ are radii of the particles in contact with each other, and a is a distance between the particles. In order to reduce the adhesion force, it is effective to increase the distance a and to decrease the contact area (number of contact points) by intervening fine particles having a radius extremely smaller than the colored particles between the colored particles and the surface of the latent image holding member or the surface of the charge controlling member. The effect can be stably maintained by using the monodisperse spherical inorganic oxide defined in the invention.

DETAILED DESCRIPTION OF THE INVENTION

Figure 1:
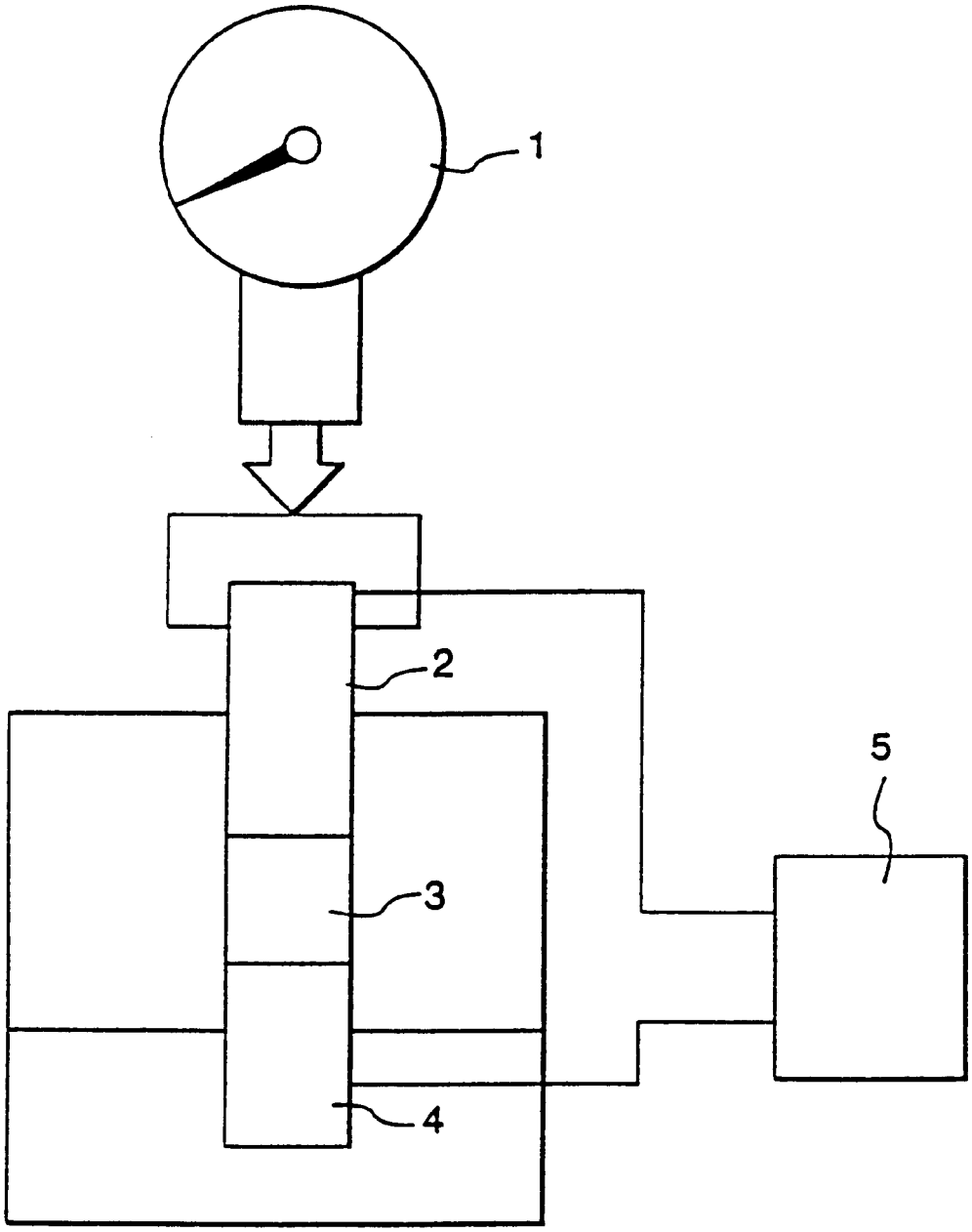
FIG. 1 is a schematic diagram of an apparatus used in the measurement of resistance.

The invention will be described in detail below.

(Toner for Developing Electrostatic Latent Image)

The toner for developing an electrostatic latent image of the invention comprising colored particles containing a binder resin, a coloring agent and a releasing agent, and a monodisperse spherical inorganic oxide as an external additive, and may further contain other components depending on necessity.

The colored particles preferably has a shape coefficient of 125 or less, so as to obtain high developing property and transferring property and an image having high quality. The colored particles preferably have a volume average particle diameter of from 2 to 8 $\mu$m.

As the spherical inorganic oxide of the invention, silica, a mixed compound of silica and titania, and a mixed compound of silica and alumina can be used.

(Monodisperse Spherical Silica)

The monodisperse spherical silica used in the invention has a true specific gravity of from 1.3 to 1.9 and a volume average particle diameter of from 80 to 300 nm.

By controlling the true specific gravity to 1.9 or less, peeling from the colored particles can be suppressed. By controlling the true specific gravity to 1.3 or more, aggregation and dispersion can be suppressed. The monodisperse spherical silica in the invention preferably has a true specific gravity of from 1.4 to 1.8.

When the volume average particle diameter of the monodisperse spherical silica is less than 80 nm, it is liable to be buried in the colored particles due to the stress in the developing device, to cause notable deterioration in the improvement effect of development and transferring. When it exceeds 300 nm, on the other hand, they are liable to be come off from the colored particles, whereby they are liable not to effectively function for reduction in non-electrostatic adhesion force, and at the same time, they are liable to be transferred to a contact member. The monodisperse silica used in the invention preferably has a volume average particle diameter of from 100 to 200 nm.

Because the monodisperse spherical silica is monodisperse and spherical, they are uniformly dispersed on the surface of the colored particles to obtain a stable spacer effect.

The term monodisperse used herein can be discussed by the standard deviation of the average particle diameter including aggregated bodies, and is preferably a standard deviation of $D_{50}$·0.22 ($D_{50}$: volume average particle diameter). The term spherical used herein can be discussed by the spherical degree of Wadell, and is-preferably a spherical degree of 0.6 or more, and more preferably 0.8 or more.

Silica is preferred as the spherical inorganic oxide because it has a diffraction factor of about 1.5, and even when the particle diameter thereof is large, it does not cause affects, such as decrease in transparency due to light scattering and the PE value upon applying an image to an OHP.

General fumed silica has a true specific gravity of 2.2, and the particle diameter thereof is limited to 50 nm at most from the standpoint of production thereof. While the particle diameter can be increased as an agglomerated body, uniform dispersion and a stable spacer effect cannot be obtained. Examples of the other inorganic fine particles used as an external additive include titanium oxide (true specific gravity: 4.2, refraction factor: 2.6), alumina (true specific gravity: 4.0, refraction factor: 1.8) and zinc oxide (true specific gravity: 5.6, refraction factor: 2.0). Since they have a large specific gravity, when the particle diameter thereof is increased to 80 nm or more for effectively exhibiting the spacer effect, it is liable to be come off from the colored particles, and the dropped particles are liable to migrate to the charge controlling member and the latent image holding member, so as to cause charge lowering and image defects. The inorganic material having a large particle diameter is not suitable to form a color image due to the high refraction factor thereof.

Furthermore, in order to control the flowability and the charging property of the toner, the monodisperse spherical silica must be sufficiently dispersed on the surface of the colored particles. There are cases where the sufficient covering cannot be attained only by spherical silica having a large particle diameter, and therefore it is preferred to use an inorganic compound having a small particle diameter in combination. As the inorganic compound having a small particle diameter, an inorganic compound having a volume average particle diameter of 80 nm or less is preferred, and an inorganic compound having a volume average particle diameter of 50 nm or less is more preferred.

The monodisperse spherical silica having a true specific gravity of from 1.3 to 1.9 and a volume average particle diameter of from 80 to 300 nm can be obtained by a sol-gel method, which is one of the wet methods. Because the silica is produced by the wet method without baking, the true specific gravity can be controlled low in comparison to a vapor phase oxidation method. It can be further adjusted by the species of the hydrophobic treatment or the treating amount in the hydrophobic treatment step. The particle diameter can be freely controlled by the hydrolysis in the sol-gel method, and the weight ratio of an alkoxysilane, ammonia, an alcohol and water, the reaction temperature, the stirring rate and the supplying rate in the condensation step. The monodisperse and spherical nature can be attained by this method.

Specifically, tetramethoxysilane is added dropwise and stirred in the presence of water and an alcohol using aqueous ammonia as a catalyst. A suspension of silica sol obtained by the reaction is subjected to centrifugation to separate into wet silica gel, an alcohol and aqueous ammonia. A solvent is added to the wet silica gel to again form silica sol, to which a hydrophobic treatment agent to subject the surface of the silica to a hydrophobic treatment. As the hydrophobic treatment agent, a general silane compound can be used. The solvent is removed from the silica sol subjected to the hydrophobic treatment, followed by drying and sieving, so as to obtain the objective monodisperse spherical silica. The resulting silica may be again subjected to the treatment.

The production process of the monodisperse spherical silica in the invention is not limited to the production process described in the foregoing.

As the silane compound, a water-soluble silane compound can be used. Examples of the silane compound include a compound represented by a chemical structural formula $R_aSiX_{4-a}$ (wherein a represents an integer of from 0 to 3, R represents a hydrogen atom or an organic group, such as an alkyl group and an alkenyl group, and X represents a chlorine atom or a hydrolytic group, such as a methoxy group and an ethoxy group), and also all types of chlorosilane, alkoxysilane, silazane and a special silylation agent can be employed.

Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phneyltrimethoxysilane, diphenyldimethoxysilane, tetraethoxysilane, methyltriethoxysilane, dimethyldiethoxysilane, phneyltriethoxysilane, diphenyldiethoxysilane, isobutyltrimethoxysilane, decyltrimethoxysilane, hexamethyldisilazane, N,O-bis(trimethylsilyl)acetamide, N,N-bis(trimethylsilyl)urea, tert-butyldimethylchlorosilane, vinyltrichlorosilane, vinyltrimethoxysilane, vinyltriethoxysilane, γ-methcryloxypropyltrimethoxysilane, β(3, 4-epoxycyclohexyl)ethyltrimethoxysilane, γ-glycidoxypropylmethyldiethoxysilane, γ-mercaptopropyltrimethoxysilane and γ-chloropropyltrimethoxysilane.

The hydrophobic treatment agent used in the invention is particularly preferably dimethyldimethoxysilane, hexamethyldisilazane, methyltrimethoxysilane, isobutyltrimethoxysilane and decyltrimethoxysilane.

The addition amount of the monodisperse spherical silica is preferably from 0.5 to 5 parts by weight, and more preferably from 1 to 3 parts by weight, per 100 parts by weight of the colored particles. When the addition amount is less than 0.5 part by weight, the decreasing effect of the non-electrostatic adhesion force is small, and there are cases where the improving effect of development and transferring cannot be sufficiently obtained. When the addition amount is more than 5 parts by weight, on the other hand, it exceeds such an amount that the silica covers the surface of the colored particles as one layer to cause excessive coating, and the silica migrates to a contacting member to cause a secondary fault.

(Binder Resin)

Examples of the binder resin include a homopolymer and a copolymer of a styrene series compound, such as styrene and chlorostyrene, a monoolefin, such as ethylene, propylene, butylene and isoprene, a vinyl ester compound, such as vinyl acetate, vinyl propionate, vinyl benzoate and vinyl butylate, an α-methylene aliphatic monocarboxylic acid ester series compound, such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, a vinyl ether series compound, such as vinyl methyl ether, vinyl ethyl ether and vinyl butyl ether, and a vinyl ketone series compound, such as vinyl methyl ketone, vinyl hexyl ketone and vinyl isopropenyl ketone. Representative examples of the binder resin include polystyrene, a styrene-alkyl acrylate copolymer, a styrene-alkyl methacrylate copolymer, styrene-acrylonitrile copolymer, a styrene-butadiene copolymer, a styrene-maleic anhydride copolymer, polyethylene and polypropylene. Further examples thereof include polyester, polyurethane, an epoxy resin, a silicone resin, polyamide, modified rosin and paraffin wax.

(Coloring Agent)

Examples of the coloring agent include magnetic powder, such as magnetite and ferrite, carbon black, Aniline Blue, Charcoil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Yellow 180, C.I. Pigment Blue 15:1 and C.I. Pigment Blue 15:3.

(Releasing Agent)

Examples of the releasing agent include low molecular weight polyethylene, low molecular weight polypropylene, Fischer-Tropsch wax, montan wax, carnauba wax, rice wax and candelilla wax.

The addition amount of the releasing agent is preferably from 1 to 15 parts by weight, and more preferably from 3 to 10 parts by weight, per 100 parts by weight of the binder resin. When the addition amount is less than 1 part by weight, there are cases where the effect thereof is not exhibited. When the addition amount is larger than 15 parts by weight, there are cases where the flowability is remarkably deteriorated and the charge distribution is extremely broadened.

(Other Components)

A charge controlling agent may be added to the toner for developing an electrostatic latent image of the invention depending on necessity. As the charge controlling agent, known ones can be used, and an azo series metallic complex compound, a metallic complex compound of salicylic acid and a resin type charge controlling agent containing a polar group are preferably used. In the case where the toner is produced by a wet production method, it is preferred to use a material that is difficult to be dissolved in water from the standpoint of controlling the ionic strength and reduction in waste water contamination. The toner of the invention may be either a magnetic toner containing a magnetic material or a non-magnetic toner containing no magnetic material.

In the toner for developing an electrostatic latent image of the invention, an inorganic compound having a small particle diameter may be used in combination with the monodisperse spherical silica as an external additive. As the inorganic compound having a small particle diameter, known ones can be used, such as silica, alumina, titania, calcium carbonate, magnesium carbonate, calcium phosphate and cerium oxide. The inorganic fine particles may be subjected to a known surface treatment depending on the object.

Among them, metatitanic acid $TiO(OH)_2$ can provide a developer that is excellent in charging property, environmental stability, flowability, caking resistance, stable negative charging property and stable image quality maintenance property.

The inorganic compound having a small particle diameter preferably has a volume average particle diameter of 80 nm or less, and more preferably 50 nm or less.

The metatitanic acid can be generally produced by the following sulfuric acid process (wet process) using ilmenite.

$$FeTiO_2+2H_2SO_4 \rightarrow FeSO_4+TiOSO_4+2H_2O\ TiOSO_4+2H_2O \rightarrow TiO(OH)_2+H_2SO_4$$

In the invention, the silane compound is added in the state of $TiO(OH)_2$ or in the state of dispersion in water of $TiO(OH)_2$ to treat a part of or the entire OH groups, which is then subjected to filtration, washing, drying and pulverization, so as to obtain specific titanic acid compound having a smaller true specific gravity than the conventional crystalline titanium oxide (obtained by baking $TiO(OH)_2$ obtained by the sulfuric acid process described in the foregoing). That is, when the reaction is conducted in the solution as in the invention, $TiO(OH)_2$ is treated with the silane compound upon its hydrolysis. As a result, the specific titanium oxide formed from $TiO(OH)_2$ in the state of primary particle is subjected to the surface treatment of the silane compound. Accordingly, the specific titanium oxide in the form of primary particle without aggregation can be obtained to attain the object.

In the invention, the inorganic compound having a small particle diameter is added to the colored particles and mixed therewith. The mixing can be conducted by using a known mixing apparatus, such as a V-blender, a Henschel mixer and a redige mixer.

The compound obtained by subjecting metatitanic acid to the hydrophobic treatment preferably has an electric resistance of $10^{10}\Omega\cdot$cm or more because the surface of the coloring agent is subjected to a surface treatment with the compound, a high transferring property can be obtained without formation of an inversely polarized toner even when the transferring electric field is increased.

At this time, various additives may be added depending on necessity. Examples of the additives include another fluidizing agent and a cleaning aid or a transferring aid, such as polystyrene fine particles, polymethyl methacrylate fine particles and polyvinylidene fluoride fine particles.

In the invention, the adhesion of the inorganic compound (such as the compound obtained by subjecting metatitanic acid to the hydrophobic treatment) on the surface of the colored particles may be simply mechanical adhesion or may be loosely fixed on the surface. It may be adhered on the entire surface of the colored particles or only a part of the surface. The addition amount of the inorganic compound is preferably from 0.3 to 3 parts by weight, and more preferably from 0.5 to 2 parts by weight, per 100 parts by weight of the colored particles. When the addition amount is less than 0.3 part by weight, there are cases where the flowability of the toner cannot be sufficiently obtained, and the suppress of blocking tends to be insufficient on storage under heat. When the addition amount is more than 3 parts by weight, on the other hand, excessive amount of the inorganic compound is covered on the surface, and the excessive inorganic compound migrates to the contact member to cause secondary fault.

After mixing the external additive, the toner may be subjected to a sieving step.

The toner for developing an electrostatic latent image of the invention can be preferably produced by the production process described in the following, but the production process is not limited to the same.

(Process for Producing Toner for Developing Electrostatic Latent Image)

The process for producing a toner for developing an electrostatic latent image of the invention contains a step of mixing monodisperse spherical silica having a true specific gravity of from 1.3 to 1.9 and a volume average particle diameter of from 80 to 300 nm with colored particles containing at least a binder resin, a coloring agent and a releasing agent, and a step of adding and mixing an inorganic compound having a smaller particle diameter than the monodisperse spherical silica with a sharing force smaller than that applied in the previous mixing step.

The production process of the colored particles will be described below.

Examples of the production method of the colored particles include a kneading and pulverization method where a binder resin, a coloring agent, a releasing agent and depending on necessity a charge controlling agent are subjected to mixing, pulverization and classification; a method where particles obtained by the kneading and pulverization method are subjected to change of shape by a mechanical impact force or heat energy; an emulsion aggregation method where a polymerizable monomer of a binder resin is subjected to emulsion polymerization, and the resulting dispersion is mixed with a dispersion of a coloring agent, a releasing agent and depending on necessity a charge controlling agent, followed by aggregation and heat fusion, to obtain the colored particles; a suspension polymerization method where a polymerizable monomer of a binder resin, a coloring agent, a releasing agent and depending on necessity a charge controlling agent are suspended in an aqueous solvent, followed by polymerization; and a dissolved suspension method where a solution of a binder resin, a coloring agent, a releasing agent and depending on necessity a charge controlling agent is suspended in an aqueous solvent to form particles. Furthermore, it is possible to conduct a production method for forming a core/shell structure, in which aggregated particles are further adhered on the colored particles obtained by the methods described in the foregoing, followed by heat fusion.

The method for adding the external additive to the resulting colored particles will be then described below.

When the monodisperse spherical silica and the inorganic compound having a small particle diameter are simultaneously added and mixed with the colored particles, the inorganic compound having a small particle diameter are selectively adhered on the surface of the colored particles, and it is not preferred since the amount of the disengaged monodisperse spherical silica having a larger particle diameter is increased.

When the inorganic compound having a small particle diameter is firstly added and mixed, the flowability of the colored particles is extremely increased, and thus a sharing force is difficult to be applied in the subsequent mixing step, whereby uniform dispersion of the monodisperse spherical silica on the surface of the colored particles becomes difficult. Particularly in the case where spherical colored particles are used, the phenomenon becomes remarkable.

As a result of various investigations on the mixing method, the effect of the invention can be effectively obtained when the colored particles and the monodisperse spherical silica having a true specific gravity of from 1.3 to 1.9 and a volume average particle diameter of from 80 to 300 nm are firstly mixed, and the inorganic compound having a smaller particle diameter than the spherical silica is then mixed with a sharing force smaller than that applied in the previous mixing step.

In the invention, the addition and mixing of the monodisperse spherical silica in the colored particles can be conducted by using a known mixer, such as a V-blender, a Henschel mixer and a redige mixer.

According to the production process of the invention, the toner for developing an electrostatic latent image of the invention can be produced.

(Developer for Developing Electrostatic Latent Image)

The developer for developing an electrostatic latent image of the invention contains the toner for developing an electrostatic latent image of the invention and a carrier.

While the toner for developing an electrostatic latent image contains the monodisperse spherical silica, there are cases where changes with the lapse of time, such as burying and peeling, occur due to the stress by the carrier, and the high transferring performance in the initial stage is difficult to be maintained. Particularly in the case of the colored particles having a shape coefficient approaching 100, the external additive is difficult to escape to suffer uniform stress, and thus such changes with the lapse of time are liable to occur. In order to reduce the stress by the carrier to maintain the high image quality, it is preferred to control the shape coefficient, the true specific gravity and the saturation magnetization of the carrier.

The shape coefficient of the carrier is preferably 120 or less, and is more preferably approaching 100 as possible. When the shape coefficient of the carrier exceeds 120, it becomes difficult to obtain sufficient transferring characteristics.

The true specific gravity of the carrier is preferably from 3 to 4, and the saturation magnetization thereof under the condition of 5 kOe is preferably 60 emu/g. When the true specific gravity is smaller, it is more advantageous against the stress, but when the true specific gravity is too small, the magnetic force per one carrier particle is lowered to cause scattering of carrier to the latent image holding member. In order to attain both the requirements, when the true specific gravity is 3 or more and the saturation magnetization is 60 emu/g or more, both the low stress and the suppress of scattering of the carrier can be simultaneously realized. When the true specific gravity is less than 3, there are cases where scattering of the carrier occurs even though the saturation magnetization is 60 emu/g or more.

With respect to the stress applied to the toner, the maintenance of the transferring property can be greatly improved by making the true specific gravity 4 or less. There are cases where the maintenance of the transferring property becomes insufficient by using iron (having a true specific gravity of from 7 to 8), ferrite or magnetite (each having a true specific gravity of from 4.5 to 5), which have been conventionally used.

By coating a resin coating layer containing a matrix resin having a conductive material dispersed therein on a core material to form a resin coating carrier, even when peeling of the resin coating layer occurs, the volume resistivity is not largely changed to exhibited high image quality for a long period of time.

Examples of the matrix resin include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, a vinyl chloride-vinyl acetate copolymer, a styrene-acrylic acid copolymer, a linear silicone resin containing an organosiloxane bond and a modified product thereof, a fluorine resin, polyester, polyurethane, polycarbonate, a phenol resin, an amino resin, a melamine resin, a benzoguanamine resin, a urea resin, an amide resin and an epoxy resin, but the matrix resin is not limited to these examples.

Examples of the conductive material include a metal, such as gold, silver and copper, titanium oxide, zinc oxide, barium sulfate, aluminum borate, potassium titanate, tin oxide and carbon black, but the conductive material is not limited to these examples.

The amount of the conductive material contained is preferably from 1 to 50 parts by weight, and more preferably from 3 to 20 parts by weight, per 100 parts by weight of the matrix resin.

Examples of the core material of the carrier include magnetic powder that is solely used as the core material as it is, and particles obtained by making magnetic powder into fine particles, which are then dispersed in a resin. Examples of the method for making magnetic powder into fine particles, and then they are dispersed in a resin include a method where the resin and the magnetic powder are kneaded and then pulverized, a method where the resin and the magnetic powder are melted and subjected to spray drying, and a polymerization method where the resin containing the magnetic powder is formed by polymerization in a solution. From the standpoint of controlling the true specific gravity and the shape of the carrier, the core material of the magnetic powder dispersion type is preferably produced by the polymerization method since a high freedom can be obtained.

It is preferred that the carrier contains the fine particles of magnetic powder in an amount of 80% by weight based on the total weight of the carrier since the scattering of the carrier is difficult to occur.

Examples of the magnetic material (magnetic powder) include a magnetic metal, such as iron, nickel and cobalt, and a magnetic oxide, such as ferrite and magnetite.

The core material generally has an average particle diameter of from 10 to 500 $\mu$m, and preferably from 25 to 80 $\mu$m.

Examples of the method for forming the resin coating layer on the surface of the core material of the carrier include a dipping method where the carrier core material is dipped in a solution for forming the coating layer containing the matrix resin, the conductive material and a solvent, a spray method where the solution for forming the coating layer is sprayed on the surface of the carrier core material, a fluidized bed method where the solution for forming the coating layer is sprayed on the carrier core material that drifts by fluidized air, and a kneader coater method where the carrier core material and the solution for forming the coating layer are mixed in a kneader coater, and the solvent is then removed.

The solvent used in the solution for forming the coating layer is not particularly limited as far as it dissolves the matrix resin, and examples thereof include an aromatic hydrocarbon, such as toluene and xylene, a ketone, such as acetone and methyl ethyl ketone, and an ether, such as tetrahydrofuran and dioxane.

The resin coating layer generally has an average thickness of from 0.1 to 10 $\mu$m, and in the invention the thickness is preferably from 0.5 to 3 $\mu$m for exhibiting a stable volume resistivity of the carrier with the lapse of time.

In order to realize high image quality, the volume resistivity of the carrier used in the invention is preferably from $10^6$ to $10^{14}$ $\Omega\cdot$cm, and more preferably from $10^8$ to $10^{13}$ $\Omega\cdot$cm, at 1,000 V, which corresponds to the upper and lower limits of the general development contrast potential. When the volume resistivity of the carrier is less than $10^6$ $\Omega\cdot$cm, the reproducibility of thin lines is inferior, and toner fogging on the background area due to implantation of charge is liable to occur. When the volume resistivity of the carrier exceeds $10^{14}$ $\Omega\cdot$cm, on the other hand, the reproducibility of a black solid image and half tone becomes inferior. Furthermore, the amount of carrier that migrates to the photoreceptor is increased, and the photoreceptor is liable to be injured.

(Process for Forming Image)

The process for forming an image of the invention contains a step of developing an electrostatic latent image formed on a latent image holding member with a toner to form a toner image, and a step of transferring the toner image to a transferring material to form a transferred image, in which the toner is a toner for developing an electrostatic latent image of the invention.

In the case where a full color image is produced in the process for forming an image of the invention, from the standpoint of purpose flexibility of paper and high image quality, it is preferred that color toner images of respective colors are transferred to an intermediate transferring belt or an intermediate transferring drum, and then the color toner images of respective colors are transferred to a transferring material at a time. When the monodisperse spherical silica and a compound obtained by subjecting metatitanium acid to a hydrophobic treatment having an electric resistance of $10^{10}$ Ω·cm are applied to the surface of the colored particles of respective colors, a high transferring property can be obtained without formation of an inversely polarized toner. The high transferring property can be obtained not only in the initial stage, but also after applying the stress with the lapse of time.

As the intermediate transferring belt and the intermediate transferring drum, known ones can be employed. In the case where the transferring and the fixing are simultaneously conducted, those having a multi-layer structure containing a base layer and a surface layer can be employed.

As the base layer, a resin film containing a conductive filler, such as carbon black and a metallic oxide, can be used. As the uppermost surface layer, a film formed with a material having a low surface energy is preferably used for improving the releasability of the toner. It is important that both the materials are heat resistant films, and films of PFA (tetrafluoroethylene-perfluoroalkyl vinyl ether copolymer), PTFE (polytetrafluoroethylene), polyimide and silicone can be used, but they are not limited to these examples.

In the case where a full color image is formed by the process for forming an image of the invention, an image of high image quality can be obtained in such a manner that the monodisperse spherical silica and the compound obtained by subjecting metatitanium acid to a hydrophobic treatment having an electric resistance of $10^{10}$ Ω·cm are applied to the surface of the colored particles of respective colors, color toner images of respective colors are transferred to an intermediate transferring belt or an intermediate transferring drum, and then the color toner images of respective colors are transferred to a transferring material at a time. In particular, it does not affect the PE value upon applying the image to an OHP.

The blade cleaning method has been generally employed because it exhibits high performance stability. However, in the process for forming an image of the invention, the residual toner remaining on the latent image holding member can be recovered with an electrostatic brush by using the toner of the invention, whereby the service life of the latent image holding member can be greatly prolonged.

As the electrostatic brush, a fibrous substance of a resin containing a conductive filler, such as carbon black or a metallic oxide, or a fibrous substance having a coating of the resin, but it is not limited to the examples.

In the process for forming an image of the invention, in the case where the residual toner remaining on the latent image holding member is recovered to the developing device without providing any cleaning system on the latent image holding member, the toner is not selectively accumulated to obtain stable development, transferring and fixing performance because the toner of the invention is used.

The invention will be further described in detail with reference to the examples below, but the invention is not construed as being limited thereto. In the following description, all parts are parts by weight.

The measurements on production of the toner for developing an electrostatic latent image, the carrier and the developer for developing an electrostatic latent image are conducted in the following manners.

(Measurement of True Specific Gravity)

The true specific gravity is measured according to JIS K0061, 5-2-1 by using a Le Chatelier's pycnometer. The operation of the measurement is as follows.

(1) About 250 ml of ethyl alcohol is put in a Le Chatelier's pycnometer and adjusted that the meniscus is positioned at the scale.

(2) The pycnometer is immersed in a thermostat water bath, and when the liquid temperature becomes 20.0±0.2° C., the position of the meniscus is precisely read by the scale of the pycnometer (accuracy: 0.025 ml).

(3) About 100 g of a sample is weighed and the mass thereof is designated as W.

(4) The weighed sample is put in the pycnometer and defoamed.

(5) The pycnometer is immersed in a thermostat water bath, and when the liquid temperature becomes 20.0±0.2° C., the position of the meniscus is precisely read by the scale of the pycnometer (accuracy: 0.025 ml).

(6) The true specific gravity is calculated by the following equations:

$$D=W/(L2-L1)$$

$$S=D/0.9982$$

wherein D is a density of the sample at 20° C. (g/cm$^3$), S is a true specific gravity of the sample at 20° C., W is an apparent mass of the sample (g) , L1 is a scale reading of the meniscus before putting the sample in the pycnometer at 20° C. (ml), L2 is a scale reading of the meniscus after putting the sample in the pycnometer at 20° C. (ml), and the value of 0.9982 is the density of water (g/cm$^3$) at 20° C.

(Measurement of Primary Particle Diameter and Standard Deviation Thereof of External Additive)

The primary particle diameter and the standard deviation thereof are measured by using a laser diffraction and scattering type particle size distribution measuring apparatus (LA-910 produced by Horiba, Ltd.).

(Spherical Degree)

The spherical degree is measured by Wadell's true spherical degree represented by the following equation:

Spherical degree=(Surface area of sphere having the same volume as actual particle (1))/(Surface area of actual particle (2))

(1) is obtained by calculation based on the average particle diameter, and (2) is substituted by a BET specific surface area measured by a measuring apparatus of powder specific surface area SS-100 produced by Shimadzu Corp.

(Shape Coefficient of Colored Particles)

The shape coefficient of the colored particles means the value calculated by the following equation, and in the case of a true sphere, the shape coefficient is 100:

$$\text{Shape coefficient of colored particles}=(R^2/S)\cdot(\pi/4)\cdot 100$$

wherein R represents a maximum length of a diameter of the colored particles, and S represents a projected area of the colored particles.

As in specific means for obtaining the shape coefficient, a toner image is imported from an optical microscope to an image analyzer (LUZEX III produced by Nireco Corp.). The diameter corresponding to a circle is measured, and the shape coefficients of the respective particles are obtained from the maximum length and the area by the equation.

(Shape Coefficient of Carrier)

The shape coefficient of the carrier means the value calculated by the following equation, and in the case of a true sphere, the shape coefficient is 100:

$$\text{Shape coefficient of carrier}=(R'^2/S')\cdot(\pi/4)\cdot 100$$

wherein R' represents a maximum length of a diameter of the carrier, and S' represents a projected area of the carrier.

The specific means for obtaining the shape coefficient is the same as in the case of the colored particles.

(Measurement of Saturation Magnetization)

A constant amount of a sample is weighed for a VSM thermostat sample case (H-2902-151), and after accurately weighing the sample, the saturation magnetization is measured in a magnetic field of 5 koe by using a vibration sample type magnetometer BHV-525 (produced by Riken Electron Co., Ltd.). (Measurement of Volume Resistivity) As shown in FIG. 1, a measurement sample 3 having a thickness H is sandwiched and retained by a lower electrode 4 and an upper electrode 2, and the thickness is measured by a dial gauge with applying pressure from above, with measuring an electric resistance of the sample 3 by a high voltage ohm meter 5. Specifically, pressure of 500 kg/cm$^2$ is applied to a specific titanium oxide sample by a forming machine to produce a measurement disk. After cleaning the surface of the disk with a brush, the disk is sandwiched between the upper electrode 2 and the lower electrode 4 inside the cell, and the thickness thereof is measured by a dial gauge. A voltage is then applied, the electric current value is read to obtain the volume resistivity.

Furthermore, a sample of the carrier is filled in the lower electrode 4 having a diameter of 100 ϕ, on which the upper electrode 2 is set, and a load of 3.43 kg is applied thereon, with measuring the thickness by a dial gauge. A voltage is then applied, the electric current value is read to obtain the volume resistivity.

In each of the following examples and comparative examples, one of external additives (A) to (K) described below.

(A) Monodisperse Spherical Silica A

Silica sol obtained by a sol-gel method is subjected to an HMDS treatment, and monodisperse spherical silica A is obtained through drying and pulverization, which has a true specific gravity of 1.50, a spherical degree ψ of 0.85, and a volume average particle diameter $D_{50}$ of 135 nm with a standard deviation of 29 nm.

(B) Monodisperse Spherical Silica B

Silica sol obtained by a sol-gel method is subjected to an HMDS treatment, and monodisperse spherical silica B is obtained through drying and pulverization, which has a true specific gravity of 1.60, a spherical degree ψ of 0.90, and a volume average particle diameter $D_{50}$ of 80 nm with a standard deviation of 13 nm.

(C) Monodisperse Spherical Silica C

Silica sol obtained by a sol-gel method is subjected to an HMDS treatment, and monodisperse spherical silica C is obtained through drying and pulverization, which has a true specific gravity of 1.50, a spherical degree ψ of 0.70, and a volume average particle diameter $D_{50}$ of 100 nm with a standard deviation of 40 nm.

(D) Monodisperse Spherical Silica D

Silica sol obtained by a sol-gel method is subjected to an isobutyltrimethoxysilane treatment, and monodisperse spherical silica D is obtained through drying and pulverization, which has a true specific gravity of 1.30, a spherical degree ψ of 0.70, and a volume average particle diameter $D_{50}$ of 100 nm with a standard deviation of 20 nm.

(E) Monodisperse Spherical Silica E

Silica sol obtained by a sol-gel method is subjected to a decyltrimethoxysilane treatment, and monodisperse spherical silica E is obtained through drying and pulverization, which has a true specific gravity of 1.90, a spherical degree ψ of 0.60, and a volume average particle diameter $D_{50}$ of 200 nm with a standard deviation of 40 nm.

(F) Fumed Silica

Commercially available fumed silica RX50 (produced by Nippon Aerosil Co., Ltd.) is used, which has a true specific gravity of 2.2, a spherical degree ψ of 0.58, and a volume average particle diameter $D_{50}$ of 40 nm with a standard deviation of 20 nm.

(G) Silicone Resin Fine Particles

The silicone resin fine particles used have a true specific gravity of 1.32, a spherical degree ψ of 0.90, and a volume average particle diameter $D_{50}$ of 500 nm with a standard deviation of 100 nm.

(H) Polymethyl Methacrylate Resin Fine Particles

The polymethyl methacrylate resin fine particles used have a true specific gravity of 1.16, a spherical degree ψ of 0.95, and a volume average particle diameter $D_{50}$ of 300 nm with a standard deviation of 100 nm.

(I) Monodisperse Spherical Silica I

Silica sol obtained by a sol-gel method is subjected to an HMDS treatment, and monodisperse spherical silica I is obtained through drying and pulverization, which has a true specific gravity of 1.60, a spherical degree ψ of 0.90, and a volume average particle diameter $D_{50}$ of 100 nm with a standard deviation of 20 nm.

(J) Fumed Silica

Commercially available fumed silica RX200 (produced by Nippon Aerosil Co., Ltd.) is used, which has a true specific gravity of 2.2, a spherical degree ψ of 0.40, and a volume average particle diameter $D_{50}$ of 12 nm with a standard deviation of 5 nm.

(K) Styrene-Methyl Methacrylate Copolymer Fine Particles

The styrene-methyl methacrylate copolymer fine particles used have a true specific gravity of 1.10 a spherical degree ψ of 0.95, and a volume average particle diameter $D_{50}$ of 100 nm with a standard deviation of 50 nm.

| (Production of Colored Particles A (Black)) | |
|---|---|
| Styrene-n-Butyl acrylate resin<br>(Tg: 58° C., Mn: 4,000, Mw: 24,000) | 100 parts |
| Carbon black<br>(Mogal L produced by Cabot Corp.) | 3 parts |

A mixture of the components described above is kneaded in an extruder, and after pulverizing by a jet mill, it is dispersed by a classifier, so as to obtain the colored particles A (Black) having a volume average particle diameter $D_{50}$ of 5.0 μm and a shape coefficient of 139.8.

(Production of Colored Particles B (Black))

| Preparation of Resin Dispersion (1) | |
|---|---|
| Styrene | 370 g |
| n-Butyl acrylate | 30 g |
| Acrylic acid | 8 g |
| Dodecane thiol | 24 g |
| Carbon tetrabromide | 4 g |

The components described above are mixed and dissolved, which is emulsified in a flask in 550 g of ion exchanged water having 6 g of a nonionic surfactant (Nonipole 400 produced by Sanyo Chemicals Co., Ltd.) and 10 g of an anionic surfactant (Neogen SC produced by Daiichi Kogyo Seiyaku Co., Ltd.) dissolved therein. The emulsion is slowly stirred over 10 minutes, during which 50 g of ion exchanged water having 4 g of ammonium persulfate dissolved therein is added thereto. After replaced with nitrogen, the content of the flask is stirred and heated to 70° C. over an oil bath, and emulsion polymerization is continued for 5 hours at that temperature. As a result, a resin dispersion (1) having an average particle diameter of 155 nm, a glass transition point Tg of 59° C., and a weight average molecular weight Mw of 12,000.

| Preparation of Resin Dispersion (2) | |
|---|---|
| Styrene | 280 g |
| n-Butyl acrylate | 120 g |
| Acrylic acid | 8 g |

The components described above are mixed and dissolved, which is emulsified in a flask in 550 g of ion exchanged water having 6 g of a nonionic surfactant (Nonipole 400 produced by Sanyo Chemicals Co., Ltd.) and 12 g of an anionic surfactant (Neogen SC produced by Daiichi Kogyo Seiyaku Co., Ltd.) dissolved therein. The emulsion is slowly stirred over 10 minutes, during which 50 g of ion exchanged water having 3 g of ammonium persulfate dissolved therein is added thereto. After replaced with nitrogen, the content of the flask is stirred and heated to 70° C. over an oil bath, and emulsion polymerization is continued for 5 hours at that temperature. As a result, a resin dispersion (2) having an average particle diameter of 105 nm, a glass transition point Tg of 53° C., and a weight average molecular weight Mw of 550,000.

| Preparation of Colored Dispersion (1) | |
|---|---|
| Carbon black<br>(Mogal L produced by Cabot Corp.) | 50 g |
| Nonionic surfactant<br>(Nonipole 400 produced by Sanyo Chemicals Co., Ltd.) | 5 g |
| Ion exchanged water | 200 g |

The components described above are mixed and dissolved, which is dispersed in a homogenizer (Ultra-Turrax T50 produced by IKA Works Inc.) for 10 minutes, so as to obtain a colored dispersion (1) having a coloring agent (carbon black) particles having an average particle diameter of 250 nm dispersed therein.

| Preparation of Releasing Agent Dispersion | |
|---|---|
| Paraffin Wax<br>(HNP0190 produced by Nippon Seiro Co., Ltd., melting point: 85° C.) | 50 g |
| Cationic surfactant<br>(Sanizole B50 produced by Kao Corp.) | 5 g |
| Ion exchanged water | 200 g |

The components described above are heated to 95° C., which are dispersed in a stainless steel flask by a homogenizer (Ultra-Turrax T50 produced by IKA Works Inc.) for 10 minutes, and are further dispersed in a pressure discharge type homogenizer, so as to obtain a releasing agent dispersion having releasing agent particles having an average particle diameter of 550 nm dispersed therein.

| Preparation of Colored Particles B (Black) | |
|---|---|
| Resin dispersion (1) | 120 g |
| Resin dispersion (2) | 80 g |
| Coloring agent dispersion (1) | 200 g |
| Releasing agent dispersion | 40 g |
| Cationic surfactant<br>(Sanizole B50 produced by Kao Corp.) | 1.5 g |

The components described above are dispersed in a stainless steel flask by a homogenizer (Ultra-Turrax T50 produced by IKA Works Inc.) . After dispersion, it is heated to 50° C. over a heating oil bath under stirring the content of the flask. After maintaining at 45° C. for 20 minutes, observation by an optical microscope reveals that aggregated particles having a volume average particle diameter of about 4.0 $\mu$m are formed. 60 g of the resin dispersion (1) is further gradually added to the mixture. The temperature of the heating oil bath is increased to 50° C. and maintained for 30 minutes. Observation by an optical microscope reveals that aggregated particles having a volume average particle diameter of about 4.8 $\mu$m are formed.

After adding 3 g of anionic surfactant (Neogen SC produced by Daiichi Kogyo Seiyaku Co., Ltd.) to the mixed solution, the stainless steel flask is sealed and heated to 105° C. with stirring by using a magnetic seal, followed by maintaining for 4 hours. After cooling, the reaction product is filtered and sufficiently washed with ion exchanged water, followed by drying, so as to obtain colored particles B (Black). The resulting colored particles B (Black) has a shape coefficient of 118.5 and a volume average particle diameter $D_{50}$ of 5.2 $\mu$m.

(Preparation of Colored Particles B (Cyan))

Colored particles B (Cyan) having a shape coefficient of 119 and a volume average particle diameter $D_{50}$ of 5.4 $\mu$m are produced in the same manner as in the production of the colored particles B (Black) except that the following coloring agent dispersion (2) is used instead of the coloring agent dispersion (1).

| Preparation of Colored Dispersion (2) | |
|---|---|
| Cyan pigment B15:3 | 70 g |
| Nonionic surfactant | 5 g |

-continued

| Preparation of Colored Dispersion (2) | |
|---|---|
| (Nonipole 400 produced by Sanyo Chemicals Co., Ltd.) | |
| Ion exchanged water | 200 g |

The components described above are mixed and dissolved, which is dispersed in a homogenizer (Ultra-Turrax T50 produced by IKA Works Inc.) for 10 minutes, so as to obtain a colored dispersion (2) having a coloring agent (cyan pigment) particles having an average particle diameter of 250 nm dispersed therein.

(Preparation of Colored Particles B (Magenta))

Colored particles B (Magenta) having a shape coefficient of 120.5 and a volume average particle diameter $D_{50}$ of 5.5 $\mu$m are produced in the same manner as in the production of the colored particles B (Black) except that the following coloring agent dispersion (3) is used instead of the coloring agent dispersion (1).

| Preparation of Colored Dispersion (3) | |
|---|---|
| Magenta pigment R122 | 70 g |
| Nonionic surfactant | 5 g |
| (Nonipole 400 produced by Sanyo Chemicals Co., Ltd.) | |
| Ion exchanged water | 200 g |

The components described above are mixed and dissolved, which is dispersed in a homogenizer (Ultra-Turrax T50 produced by IKA Works Inc.) for 10 minutes, so as to obtain a colored dispersion (3) having a coloring agent (magenta pigment) particles having an average particle diameter of 250 nm dispersed therein.

(Preparation of Colored Particles B (Yellow))

Colored particles B (Yellow) having a shape coefficient of 120 and a volume average particle diameter $D_{50}$ of 5.3 $\mu$m are produced in the same manner as in the production of the colored particles B (Black) except that the following coloring agent dispersion (4) is used instead of the coloring agent dispersion (1).

| Preparation of Colored Dispersion (4) | |
|---|---|
| Yellow pigment Y180 | 100 g |
| Nonionic surfactant | 5 g |
| (Nonipole 400 produced by Sanyo Chemicals Co., Ltd.) | |
| Ion exchanged water | 200 g |

The components described above are mixed and dissolved, which is dispersed in a homogenizer (Ultra-Turrax T50 produced by IKA Works Inc.) for 10 minutes, so as to obtain a colored dispersion (4) having a coloring agent (yellow pigment) particles having an average particle diameter of 250 nm dispersed therein.

| (Preparation of Carrier A) | |
|---|---|
| Ferrite particles (average particle diameter: 50 $\mu$m) | 100 part |
| Toluene | 14 parts |
| Styrene-methylmethacrylate copolymer (compositional ratio: 90/10) | 2 parts |

-continued

| (Preparation of Carrier A) | |
|---|---|
| Carbon black (R330 produced by Cabot Corp.) | 0.2 part |

The components described above except the ferrite particles are stirred by a stirrer for 10 minutes to prepare a coating solution. The coating solution and the ferrite particles are put in a vacuum evacuation type kneader, and after stirring at 60° C. for 30 minutes, the interior is further heated and evacuated, followed by drying, so as to produce the carrier A. The carrier A has a shape coefficient of 118, a true specific gravity of 4.5, a saturation magnetization of 63 emu/g, and a volume resistivity on application of an electric field of 1,000 V/cm of $10^{11}$ Ω·cm.

EXAMPLE 1

3 parts of the monodisperse spherical silica A is added to 100 parts each of the colored particles B (Black), the colored particles B (Cyan), the colored particles B (Magenta) and the colored particles B (Yellow), respectively. After the mixtures are blended in a Henschel mixer at a circumferential speed of 32 m/s for 10 minutes, 1 part of a compound obtained by subjecting metatitanic acid to an isobutyltrimethoxysilane treatment (volume average particle diameter $D_{50}$: 35 nm, powder resistance: $10^{12}$ Ω·cm) is added thereto. After the mixtures are blended at a circumferential speed of 20 m/s for 5 minutes, coarse particles are removed by sieving with a sieve of 45 $\mu$m mesh, so as to obtain a toner for developing an electrostatic latent image. 5 parts of the resulting toner for developing an electrostatic latent image and 100 parts of the carrier A are mixed and stirred in a V-blender at 40 rpm for 20 minutes, and the mixture is sieved with a sieve of 177 $\mu$m mesh to obtain a developer for developing an electrostatic latent image.

EXAMPLE 2

3 parts of the monodisperse spherical silica B is added to 100 parts of the colored particles B (Black). After the mixture is blended in a Henschel mixer at a circumferential speed of 32 m/s for 10 minutes, 1 part of a compound obtained by subjecting metatitanic acid to an isobutyltrimethoxysilane treatment (volume average particle diameter $D_{50}$: 35 nm, powder resistance: $10^{12}$ Ω·cm) is added thereto. After the mixture is blended at a circumferential speed of 20 m/s for 5 minutes, coarse particles are removed by sieving with a sieve of 45 $\mu$m mesh, so as to obtain a toner for developing an electrostatic latent image. 5 parts of the resulting toner for developing an electrostatic latent image and 100 parts of the carrier A are mixed and stirred in a V-blender at 40 rpm for 20 minutes, and the mixture is sieved with a sieve of 177 $\mu$m mesh to obtain a developer for developing an electrostatic latent image.

EXAMPLE 3

A developer for developing an electrostatic latent image is obtained in the same manner as in Example 2 except that the monodisperse spherical silica C is used instead of the monodisperse spherical silica B.

EXAMPLE 4

A developer for developing an electrostatic latent image is obtained in the same manner as in Example 2 except that the colored particles A (Black) are used instead of the colored particles B (Black).

EXAMPLE 5

A developer for developing an electrostatic latent image is obtained in the same manner as in Example 2 except that the monodisperse spherical silica D is used instead of the monodisperse spherical silica B.

EXAMPLE 6

A developer for developing an electrostatic latent image is obtained in the same manner as in Example 2 except that the monodisperse spherical silica E is used instead of the monodisperse spherical silica B.

EXAMPLE 7

3 parts of the monodisperse spherical silica A is added to 100 parts of the colored particles B (Black). After the mixture is blended in a Henschel mixer at a circumferential speed of 32 m/s for 10 minutes, 1 part of silica (TS720 produced by Cabot Corp., volume average particle diameter $D_{50}$: 12 nm) is added thereto. After the mixture is blended at a circumferential speed of 20 m/s for 5 minutes, coarse particles are removed by sieving with a sieve of 45 $\mu$m mesh, so as to obtain a toner for developing an electrostatic latent image. 5 parts of the resulting toner for developing an electrostatic latent image and 100 parts of the carrier A are mixed and stirred in a V-blender at 40 rpm for 20 minutes, and the mixture is sieved with a sieve of 177 $\mu$m mesh to obtain a developer for developing an electrostatic latent image.

EXAMPLE 8

3 parts of the monodisperse spherical silica B is added to 100 parts of the colored particles B (Black). After the mixture is blended in a Henschel mixer at a circumferential speed of 32 m/s for 10 minutes, 1 part of a compound obtained by subjecting rutile type titanium oxide to a decyltrimethoxysilane treatment (volume average particle diameter $D_{50}$: 20 nm) is added thereto. After the mixture is blended at a circumferential speed of 20 m/s for 5 minutes, coarse particles are removed by sieving with a sieve of 45 $\mu$m mesh, so as to obtain a toner for developing an electrostatic latent image. 5 parts of the resulting toner for developing an electrostatic latent image and 100 parts of the carrier A are mixed and stirred in a V-blender at 40 rpm for 20 minutes, and the mixture is sieved with a sieve of 177 $\mu$m mesh to obtain a developer for developing an electrostatic latent image.

EXAMPLE 9

3 parts of the monodisperse spherical silica A and 1 part of a compound obtained by subjecting metatitanic acid to an isobutyltrimethoxysilane treatment (volume average particle diameter $D_{50}$: 35 nm, powder resistance: $10^{12}$ Ω·cm) are added to 100 parts of the colored particles B (Black). After the mixture is blended in a Henschel mixer at a circumferential speed of 32 m/s for 10 minutes, coarse particles are removed by sieving with a sieve of 45 $\mu$m mesh, so as to obtain a toner for developing an electrostatic latent image. 5 parts of the resulting toner for developing an electrostatic latent image and 100 parts of the carrier A are mixed and stirred in a V-blender at 40 rpm for 20 minutes, and the mixture is sieved with a sieve of 177 $\mu$m mesh to obtain a developer for developing an electrostatic latent image.

COMPARATIVE EXAMPLE 1

A developer for developing an electrostatic latent image is obtained in the same manner as in Example 2 except that the fumed silica RX50 is used instead of the monodisperse spherical silica B.

COMPARATIVE EXAMPLE 2

A developer for developing an electrostatic latent image is obtained in the same manner as in Example 2 except that the silicone fine particles are used instead of the monodisperse spherical silica B.

COMPARATIVE EXAMPLE 3

A developer for developing an electrostatic latent image is obtained in the same manner as in Example 2 except that the polymethylmethacrylate fine particles are used instead of the monodisperse spherical silica B.

COMPARATIVE EXAMPLE 4

A developer for developing an electrostatic latent image is obtained in the same manner as in Example 2 except that the monodisperse spherical silica B is not added.

COMPARATIVE EXAMPLE 5

1 part of a compound obtained by subjecting metatitanic acid to an isobutyltrimethoxysilane treatment (volume average particle diameter $D_{50}$: 35 nm, powder resistance: $10^{12}$ Ω·cm) is added to 100 parts of the colored particles A (Black). After the mixture is blended at a circumferential speed of 20 m/s for 5 minutes, coarse particles are removed by sieving with a sieve of 45 $\mu$m mesh, so as to obtain a toner for developing an electrostatic latent image. 5 parts of the resulting toner for developing an electrostatic latent image and 100 parts of the carrier A are mixed and stirred in a V-blender at 40 rpm for 20 minutes, and the mixture is sieved with a sieve of 177 $\mu$m mesh to obtain a developer for developing an electrostatic latent image.

The developing property and the transferring property of the developers for developing an electrostatic latent image obtained in Examples 1 to 9 and Comparative Examples 1 to 5 are evaluated by a modified duplicating machine of Docu Color 1250 produced by Fuji Xerox Co., Ltd.

(Evaluation of Developing Property in Initial Stage)

After a developer of @TC5% is allowed to stand under prescribed temperature and humidity conditions (29° C.90% and 10° C.20%) over night, an image having two patches of 2 cm×5 cm is duplicated, and the developed amount is measured by a hard stop. The toner adhered on the two developed areas is transferred to an adhesive tape by utilizing the adhesiveness of the tape, and the weight of the tape having the toner adhered is measured. The developed amount is obtained by subtracting the weight of the tape, followed by obtaining the average value. The preferred range of the developed amount is from 4.0 to 5.0 g/m$^2$.

(Evaluation of Developing Property after 10,000 Sheets)

Duplication of 10,000 sheets is conducted using a developer under prescribed temperature and humidity conditions (29° C.90% and 10° C.20%), and further allowed to stand over night. An image having two patches of 2 cm×5 cm is duplicated, and the developed amount is measured by a hard stop. The toner adhered on the two developed areas is transferred to an adhesive tape by utilizing the adhesiveness of the tape, and the weight of the tape having the toner adhered is measured. The developed amount is obtained by subtracting the weight of the tape, followed by obtaining the average value.

(Evaluation of high background in Initial Stage and after 10,000 Sheets)

The toner adhered on the background area is transferred to an adhesive tape in the same manner as above, and the number of the toner is counted per 1 $cm^2$. The results are evaluated by the following grades, i.e., 100 or less for A, from 100 to 500 for B, and more than 500 for C.

(Measurement of Charging Amount in Initial Stage and after 10,000 Sheets)

In the initial stage and after duplication of 10,000 sheets, the developer on a magnet sleeve in the developing device is collected, and the charging amount is measured by TB200 produced by Toshiba Corp. under the condition of 25° C. and 55% RH.

(Evaluation of Transferring Property in Initial Stage and after 10,000 Sheets)

After completing the transferring step, hard stop is conducted, and the toner on the intermediate transferring material at the two positions is transferred to an adhesive tape in the same manner as above. The toner amount a is obtained by measuring the weight of the tape carrying the toner and subtracting the weight of the tape, followed by obtaining an average value. The toner amount b remaining on the photoreceptor is obtained in the same manner, and the transferring efficiency is obtained by the following equation.

$$\text{Transferring efficiency } \eta = a \cdot 100/(a+b)$$

The preferred value of the transferring efficiency η is 99% or less, and the results are evaluated by the following grades, i.e., 99% or more for A, 90% or more and less than 99% for B, and less than 90% for C.

The results in the initial stage are shown in Table 1, and the results after duplication of 10,000 sheets are shown in Table 2.

TABLE 1

(Initial Stage)

| | Charging property (μC/g) | | Developing property: Solid image developed amount (@ TC 5%: g/$m^2$) | | Developing property: Fogging (Grade) | | Transferring property* | |
|---|---|---|---|---|---|---|---|---|
| | 29° C. 90% | 10° C. 20% | 29° C. 90% | 10° C. 20% | 29° C. 90% | 10° C. 20% | 29° C. 90% | 10° C. 20% |
| Example. 1 (Black) | −32 | −40 | 4.5 A | 4.3 A | 75 A | 30 A | 99.6 A | 99.8 A |
| Example. 1 (Cyan) | −38 | −42 | 4.3 A | 4.1 A | 60 A | 20 A | 100 A | 100 A |
| Example. 1 (Magenta) | −30 | −38 | 4.8 A | 4.0 A | 65 A | 25 A | 99.2 A | 99.5 A |
| Example. 1 (Yellow) | −42 | −45 | 4.2 A | 4.1 A | 56 A | 35 A | 99.8 A | 99.9 A |
| Example. 2 | −33 | −40 | 4.6 A | 4.2 A | 80 A | 35 A | 99.1 A | 99.2 A |
| Example. 3 | −34 | −42 | 4.5 A | 4.1 A | 85 A | 40 A | 98.5 B | 99.0 A |
| Example. 4 | −32 | −38 | 4.6 A | 4.1 A | 80 A | 38 A | 92.5 B | 93.5 B |
| Example. 5 | −35 | −42 | 4.3 A | 4.0 A | 65 A | 35 A | 99.1 A | 99.4 A |
| Example. 6 | −33 | −38 | 4.4 A | 4.2 A | 250 B | 89 A | 98.8 B | 99.0 A |
| Example. 7 | −45 | −55 | 3.5 B | 3.2 B | 380 B | 420 B | 99.5 A | 99.7 A |
| Example. 8 | −31 | −42 | 4.7 A | 4.0 A | 110 B | 25 A | 99.2 A | 99.4 A |
| Example. 9 | −30 | −38 | 4.8 A | 4.2 A | 125 B | 55 A | 99.0 A | 99.2 A |
| Comparative Example 1 | −38 | −45 | 4.0 A | 3.8 B | 95 A | 65 A | 90.0 B | 92.3 B |
| Comparative Example 2 | −25 | −65 | 5.2 B | 2.5 C | 650 C | 20 A | 85.0 C | 90.0 B |
| Comparative Example. 3 | −35 | −46 | 4.4 A | 4.2 A | 110 B | 85 A | 96.5 B | 98.0 B |
| Comparative Example 4 | −31 | −33 | 4.8 A | 4.6 A | 75 A | 35 A | 85.0 C | 88.0 C |
| Comparative Example 5 | −35 | −38 | 4.6 A | 4.5 A | 35 A | 15 A | 65.0 C | 75.0 C |

*Transferring property: Transferring efficiency (%) = Transferring amount/Developed amount

TABLE 2

(After 10,000 sheets)

| | Charging property (μC/g) | | Developing property: Solid image developed amount (g/$m^2$) | | Developing property: Fogging (Grade) | | Transferring property* | |
|---|---|---|---|---|---|---|---|---|
| | 29° C. 90% | 10° C. 20% | 29° C. 90% | 10° C. 20% | 29° C. 90% | 10° C. 20% | 29° C. 90% | 10° C. 20% |
| Example. 1 (Black) | −30 | −42 | 4.7 A | 4.2 A | 100 A | 45 A | 99.4 A | 99.6 A |
| Example.1 (Cyan) | −36 | −40 | 4.5 A | 4.3 A | 65 A | 40 A | 99.8 A | 99.9 A |
| Example.1 (Magenta) | −33 | −36 | 4.6 A | 4.5 A | 78 A | 60 A | 99.2 A | 99.4 A |
| Example.1 (Yellow) | −42 | −46 | 4.1 A | 4.0 A | 50 A | 25 A | 99.6 A | 99.7 A |
| Example. 2 | −35 | −42 | 4.5 A | 4.1 A | 98 A | 55 A | 99.0 A | 99.0 A |
| Example. 3 | −33 | −40 | 4.7 A | 4.3 A | 110 B | 60 A | 96.5 B | 98.0 B |
| Example. 4 | −33 | −41 | 4.5 A | 4.4 A | 95 A | 55 A | 90.0 B | 91.0 B |
| Example. 5 | −35 | −48 | 4.2 A | 3.8 B | 220 B | 55 A | 99.0 A | 99.1 A |
| Example. 6 | −38 | −45 | 3.8 B | 3.5 B | 450 B | 100 A | 97.5 B | 98.0 B |
| Example. 7 | −32 | −60 | 4.2 A | 3.0 B | 490 B | 420 B | 99.3 A | 99.3 A |
| Example. 8 | −25 | −35 | 5.2 B | 4.6 A | 95 A | 55 A | 99.0 A | 99.1 A |
| Example. 9 | −30 | −35 | 4.6 A | 4.3 A | 85 A | 60 A | 96.0 B | 99.0 A |
| Comparative Example 1 | −35 | −48 | 4.1 A | 3.6 B | 102 B | 85 A | 75.0 C | 82.0 C |
| Comparatlve Example 2 | −18 | −25 | 5.8 B | 5.3 B | >1,000 C | 750 C | 75.0 C | 78 0 C |

TABLE 2-continued

| | (After 10,000 sheets) | | | | | | | |
|---|---|---|---|---|---|---|---|---|
| | | | Developing property | | | | | |
| | Charging property (μC/g) | | Solid image developed amount ($g/m^2$) | | Fogging (Grade) | | Transferring property* | |
| | 29° C. 90% | 10° C. 20% | 29° C. 90% | 10° C. 20% | 29° C. 90% | 10° C. 20% | 29° C. 90% | 10° C. 20% |
| Comparative Example 3 | −38 | −48 | 4.0 A | 3.8 B | 130 B | 100 A | 72.0 C | 75.0 C |
| Comparative Example 4 | −33 | −35 | 4.6 A | 4.2 A | 95 A | 50 A | 70.0 C | 72.0 C |
| Comparative Example 5 | −38 | −40 | 4.0 A | 3.8 B | 70 A | 30 A | 63.5 C | 68.0 C |

*Transferring property: Transferring efficiency (%) = Transferring amount/Developed amount In the duplicating machine used, the cleaning blade is removed, but a brush is installed, and the charging device is changed to a roll charging device. By using the duplicating machine, the developers for developing an electrostatic latent image obtained in Example 1 (Black) and Comparative Example 1 are evaluated in the same manner as above.

As a result, the developer (Black) obtained in Example 1 provides a clear image not only in the initial stage but also after duplicating 10,000 sheets, and causes no problem in images.

On the other hand, it is confirmed that in the developer obtained in Comparative Example 1, the residual toner forms a ghost in the subsequent image although it causes no problem in the initial stage. It also remarkably contaminates the charging roll to cause lines in an image due to charging unevenness.

In the duplicating machine used above, no blade or brush cleaning is conducted, but a scorotron charging device is used. By using the duplicating machine, the developers for developing an electrostatic latent image obtained in Example 1 (Black) and Comparative Example 1 are evaluated in the same manner as above.

As a result, the developer (Black) obtained in Example 1 provides a clear image not only in the initial stage but also after duplicating 10,000 sheets, and causes no problem in images.

On the other hand, it is confirmed that in the developer obtained in Comparative Example 1, the residual toner forms a ghost in the subsequent image although it causes no problem in the initial stage. The residual toner is accumulated to cause remarkable contamination on the background of the image, and thus the image quality is extremely deteriorated.

Furthermore, the surface material of the transferring belt is changed to PFA, and a heating device for heating from the back surface thereof is installed, so as to simultaneously conduct transferring and fixing.

Evaluation is conducted for Example 1 using four colors and the same configuration as Comparative Example 4 except that four colors are produced. In the case of Example 1, clear and high image quality that is substantially equivalent to photograph can be obtained. In the case of Comparative Example 4 producing four colors, deteriorated image quality is obtained, in which thin lines are scattered, lines are thickened when three colors are superimposed, and the inside of a latter image is dropped off.

(Preparation of Colored Particles C (Black))

Colored particles C (Black) are produced by use of following dispersion, which was used to produce the colored particles B (Black)

| | |
|---|---|
| Resin dispersion (1) | 120 g |
| Resin dispersion (2) | 80 g |
| Coloring agent dispersion (1) | 200 g |
| Releasing agent dispersion | 40 g |
| Cationic surfactant (Sanizole B50 produced by Kao Corp.) | 1.5 g |

The components described above are dispersed in a stainless steel flask by a homogenizer (Ultra-Turrax T50 produced by IKA Works Inc.). After dispersion, it is heated to 50° C. over a heating oil bath under stirring the content of the flask. After maintaining at 45° C. for 25 minutes, observation by an optical microscope reveals that aggregated particles having a volume average particle diameter of about 5.0 μm are formed. 60 g of the resin dispersion (1) is further gradually added to the mixture. The temperature of the heating oil bath is increased to 50° C. and maintained for 40 minutes. Observation by an optical microscope reveals that aggregated particles having a volume average particle diameter of about 5.8 μm are formed.

After adding 3 g of an anionic surfactant (Neogen SC produced by Daiichi Kogyo Seiyaku Co., Ltd.) to the mixed solution, the stainless steel flask is sealed and heated to 105° C. with stirring by using a magnetic seal, followed by maintaining for 4 hours. After cooling, the reaction product is filtered and sufficiently washed with ion exchanged water, followed by drying, so as to obtain colored particles C (Black). The resulting colored particles C (Black) has a shape coefficient of 103.8 and a volume average particle diameter $D_{50}$ of 6.0 μm. (Production of Carrier B)

| Core Material | |
|---|---|
| Polymer core | 100 parts |

(volume average particle diameter $D_{50}$: 35 μm, shape coefficient: 104.5, true specific gravity: 3.6, saturation magnetization: 65 emu/g)

| Coating Resin | |
|---|---|
| Perfluorooctylethyl methacrylate-methyl methacrylate copolymer (copolymerization ratio: 20/80) | 2 parts |
| Toluene | 15 parts |

-continued

| Coating Resin | |
|---|---|
| Carbon black (Vulcan XC 72 produced by Cabot Corp.) | 0.2 part |

The binder resin is dissolved in the solvent, and the resulting solution and the conductive powder (carbon black) are dispersed in a sand mill at 1,200 rpm for 30 minutes to obtain a coating resin solution.

The coating resin composition and the core material are mixed by stirring in a kneader at 60° C. and −400 mHg for 10 minutes and then dried at 100° C. and −760 mHg for 30 minutes, followed by sieving with a sieve of 75 μm mesh, so as to obtain the carrier B. The carrier B has a volume average particle diameter $D_{50}$ of 37 μm, a shape coefficient of 109.2, a true specific gravity of 3.5, a saturation magnetization of 65 emu/g, and a volume resistivity of from $10^{12.5}$ Ω·cm on application of an electric field of 1,000 V/cm,

EXAMPLE 10

2 parts of the monodisperse spherical silica I as an external additive is added to 100 parts of the colored particles C (Black). The mixture is blended in a Henschel mixer at 2,500 rpm for 10 minutes to obtain a toner for developing an electrostatic latent image. 5 parts of the resulting toner for developing an electrostatic latent image and 100 parts of the carrier B are stirred in a V-blender at 40 rpm for 20 minutes to obtain a developer for developing an electrostatic latent image.

EXAMPLE 11

A developer for developing an electrostatic latent image is obtained in the same manner as in Example 10 except that 1 part of the monodisperse spherical silica I and 1 part of the fumed silica RX200 are used instead of 2 parts of the monodisperse spherical silica I.

COMPARATIVE EXAMPLE 6

A developer for developing an electrostatic latent image is obtained in the same manner as in Example 10 except that the fumed silica RX200 is used instead of the monodisperse spherical silica I.

COMPARATIVE EXAMPLE 7

A developer for developing an electrostatic latent image is obtained in the same manner as in Example 10 except that the styrene-methyl methacrylate copolymer fine particles are used instead of the monodisperse spherical silica I.

A duplication test is conducted for the developers for developing an electrostatic latent image by using a modified duplicating machine of A-color produced by Fuji Xerox Co., Ltd. In the test, evaluation is conducted for the transferring efficiency of the developer in the developing device, the image quality, the observation by an SEM for change in burying of the external additive with the lapse of time, and the scattering of the carrier on the latent image carrier. The evaluation is conducted in the initial stage and after duplication of 10,000 sheets.

The results of evaluation are shown in Table 3 below with five grades, excellent A, good B, slightly poor C, poor D, and extremely poor E.

TABLE 3

| | Transferring efficiency | | Image quality | | SEM observation | | |
|---|---|---|---|---|---|---|---|
| | Initial stage | After 10,000 sheets duplication | Initial stage | After 10,000 sheets duplication | Initial stage | After 10,000 sheets duplication | Carrier scattering |
| Example. 10 | A | B | A | A | A | B | B |
| Example. 11 | A | A | A | A | A | A | B |
| Comparative Example 6 | C | D | A | B | B | B | B |
| Comparative Example 7 | A | D | C | D | A | D | B |

It is found from the results shown in Table 3 that the developers for developing an electrostatic latent image of Examples 10 and 11 are excellent in transferring efficiency, transferring maintaining property and image quality maintaining property.

As for the transferring efficiency, the transferring ratio from the photoreceptor through the intermediate transferring material to the paper is 95% or more in the initial stage and is maintained at 90% or more in the developer after duplication of 10,000 sheets. Particularly in the developer of Example 11, it is 99% or more in the initial stage and is maintained at 95% or more after duplication of 10,000 sheets. These developers are good in half tone image quality, solid image quality and reproduction of letters, and the image quality equivalent to that in the initial stage is obtained after duplication of 10,000 sheets.

The observation of an SEM confirms that the buried amount of the external additive with the lapse of time is small in the developers of Examples 10 and 11, and thus the transferring property and the high image quality are maintained.

On the other hand, the developer of Comparative Example 6 is poor in transferring efficiency even in the initial stage, and the transferring efficiency from the photoreceptor to the paper after duplication of 10,000 sheets is 70% or lower, whereby an image of good quality cannot be obtained. While the developer of Comparative Example 7 exhibits good transferring efficiency in the initial stage, the transferring efficiency from the photoreceptor to the paper after duplication of 10,000 sheets is 70% or lower to cause a problem in transferring maintaining property. The observation of an SEM confirms that the external additive is crushed by the stress.

It is understood from the results that the transferring characteristics approaching 100% can be obtained and maintained in a long period of time, and high image quality can be maintained by using the developer for developing an electrostatic latent image of the invention.

According to the invention, a toner for developing an electrostatic latent image, a process for producing the same, and a developer for developing an electrostatic latent image using the same can be provided, which solve the problems associated with the conventional techniques and have the following features, i.e., the toner flowability, the charging property, the developing property, the transferring property and the fixing property are simultaneously satisfied in a long period of time; a blade cleaning step accelerating the wear of a latent image holding member is not employed; and the residual transferred toner is recovered simultaneously with the development, or the residual toner remaining on the latent image carrier is recovered by an electrostatic brush. According to the invention, a process for forming an image can also be provided, in which development, transferring and fixing that cope with the demand of high image quality can be conducted.

What is claimed is:

1. A method of producing a toner comprising mixing a dispersion of binder resin particles with a dispersion of a coloring agent and a dispersion of a releasing agent;

aggregating the binder resin particles to form aggregation particles and fusing the aggregation particles to obtain colored particles;

mixing the colored particles with an external additive, wherein the external additive comprises a monodisperse spherical inorganic oxide having a true specific gravity of from about 1.3 to 1.9 and a volume average particle diameter of from about 80 to 300 nm.

2. The method of producing a toner according to claim 1, wherein the monodisperse spherical inorganic oxide is silica.

3. The method of producing a toner according to claim 1, wherein the colored particles have a shape coefficient represented by the following equation of about 125 or less:

$$\text{Shape coefficient of colored particles} = \frac{R^2}{S} \times \frac{\pi}{4} \times 100$$

wherein R represents a maximum length of a diameter of the colored particles, and S represents a projected area of the colored particles.

4. The method of producing a toner according to claim 1, wherein the external additive further comprises an inorganic compound having a volume average particle diameter of 50 nm or less.

5. The method of producing a toner according to claim 1, wherein a total amount of monodisperse spherical inorganic oxide to be added is from about 0.5 to 5 parts by weight per 100 parts by weight of the colored particles.

6. The method of producing a toner according to claim 1, wherein the monodisperse spherical inorganic oxide is made by a sol-gel method.

7. The method of producing a toner according to claim 1, further comprising sieving the toner after mixing the colored particles with the external additive.

8. The method of producing a toner according to claim 2, further comprising adding and mixing an inorganic compound having a smaller particle diameter than the monodisperse spherical silica oxide with a shearing force smaller than that applied in the mixing of the colored particles with the external additive.

9. The method of producing a toner according to claim 1, wherein the dispersion of the binder resin particles is made by emulsion polymerization.

* * * * *